US011365095B2

(12) United States Patent
Haag et al.

(10) Patent No.: US 11,365,095 B2
(45) Date of Patent: Jun. 21, 2022

(54) METHOD AND AN ARRANGEMENT FOR INSTALLING ELEVATOR GUIDE RAILS INTO AN ELEVATOR SHAFT

(71) Applicant: Kone Corporation, Helsinki (FI)

(72) Inventors: Mikael Haag, Helsinki (FI); Harri Makinen, Helsinki (FI)

(73) Assignee: Kone Corporation, Helsinki (FI)

( * ) Notice: Subject to any disclaimer, the term of this patent is extended or adjusted under 35 U.S.C. 154(b) by 106 days.

(21) Appl. No.: 16/902,482

(22) Filed: Jun. 16, 2020

(65) Prior Publication Data

US 2021/0016997 A1 Jan. 21, 2021

(30) Foreign Application Priority Data

Jul. 16, 2019 (EP) ..... 19186434

(51) Int. Cl.

| | |
|---|---|
| ***B66B 19/00*** | (2006.01) |
| ***B66B 7/02*** | (2006.01) |
| *B66B 7/04* | (2006.01) |

(52) U.S. Cl.

CPC ..... *B66B 19/002* (2013.01); *B66B 7/023* (2013.01); *B66B 7/046* (2013.01)

(58) Field of Classification Search

CPC ..... B66B 7/023; B66B 19/002

See application file for complete search history.

(56) References Cited

U.S. PATENT DOCUMENTS

| | | | | |
|---|---|---|---|---|
| 9,592,997 | B2 * | 3/2017 | Mertala | B66B 19/002 |
| 9,751,728 | B2 * | 9/2017 | Mertala | E04G 3/246 |
| 2015/0314993 | A1 | 11/2015 | Bolme et al. | |
| 2016/0311659 | A1 | 10/2016 | Mertala | |
| 2022/0033229 | A1 * | 2/2022 | Roberts | B66B 9/02 |

FOREIGN PATENT DOCUMENTS

| | | | | |
|---|---|---|---|---|
| JP | H05178561 | A | * | 7/1993 |
| JP | H05319729 | A | * | 12/1993 |
| JP | H06219665 | A | * | 8/1994 |
| JP | H06255943 | A | * | 9/1994 |
| JP | H08073153 | A | | 3/1996 |
| JP | H08245116 | A | * | 9/1996 |
| JP | 2010070296 | A | | 4/2010 |
| WO | WO-9829325 | A1 | | 7/1998 |

OTHER PUBLICATIONS

European Search Report for Application No./Patent No. 19186434.7-1017 dated Mar. 20, 2020.

* cited by examiner

*Primary Examiner* — Minh Truong
(74) *Attorney, Agent, or Firm* — Harness, Dickey & Pierce, P.L.C.

(57) ABSTRACT

The method comprises installing a lowermost first section of guide rail elements, moving a guide rail element upwards along a row of already installed guide rail elements with a transport apparatus, connecting the guide rail element to an upper end of the row of already installed guide rail elements and attaching the guide rail element to a wall of the shaft from a transport platform, moving the transport apparatus downwards along the row of already installed guide rails in order to fetch a new guide rail element.

10 Claims, 8 Drawing Sheets

Figure 1:
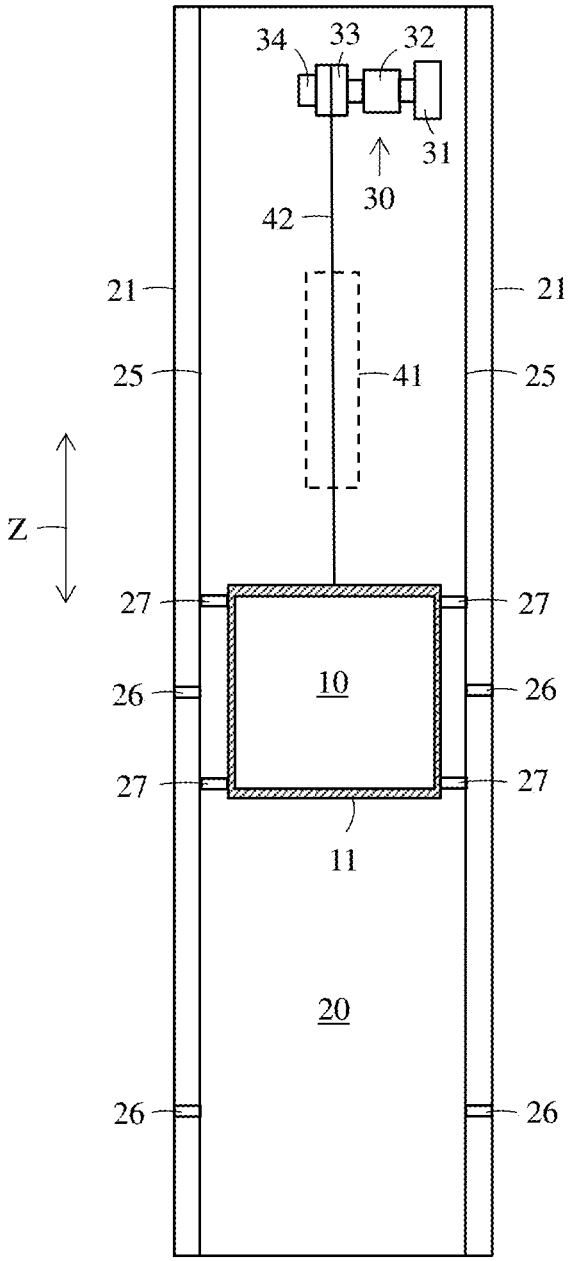

METHOD AND AN ARRANGEMENT FOR INSTALLING ELEVATOR GUIDE RAILS INTO AN ELEVATOR SHAFT

RELATED APPLICATIONS

This application claims priority to European Patent Application No. 19186434.7 filed on Jul. 16, 2019, the entire contents of which are incorporated herein by reference.

FIELD

The invention relates to a method and an arrangement for installing elevator guide rails into an elevator shaft.

BACKGROUND

An elevator may comprise a car, a shaft, hoisting machinery, ropes, and a counterweight. A separate or an integrated car frame may surround the car.

The hoisting machinery may be positioned in the shaft. The hoisting machinery may comprise a drive, an electric motor, a traction sheave, and a machinery brake. The hoisting machinery may move the car upwards and downwards in the shaft. The machinery brake may stop the rotation of the traction sheave and thereby the movement of the elevator car.

The car frame may be connected by the ropes via the traction sheave to the counterweight. The car frame may further be supported with gliding means at guide rails extending in the vertical direction in the shaft. The guide rails may be attached with fastening brackets to the side wall structures in the shaft. The gliding means keep the car in position in the horizontal plane, when the car moves upwards and downwards in the shaft. The counterweight may be supported in a corresponding way on guide rails that are attached to the wall structure of the shaft.

The car may transport people and/or goods between the landings in the building. The wall structure of the shaft may be formed of solid walls or of an open beam structure or of any combination of these.

The guide rails may be formed of guide rail elements of a certain length. The guide rail elements may be connected in the installation phase end-on-end one after the other in the elevator shaft. The guide rail elements may be attached to each other with connection plates extending between the end portions of two consecutive guide rail elements. The connection plates may be attached to the consecutive guide rail elements. The ends of the guide rails may comprise some kind of form locking means in order to position the guide rails correctly in relation to each other. The guide rails may be attached to the walls of the elevator shaft with support means at support points along the height of the guide rails.

The installation of guide rails is a labour intensive and time consuming task in an elevator installation. The problems are even more profound in modern high rise buildings.

SUMMARY

An object of the invention is an improved method and arrangement for installing elevator guide rails into an elevator shaft.

Example embodiments disclose a method for installing elevator guide rails into an elevator shaft.

Example embodiments disclose an arrangement for installing elevator guide rails into an elevator shaft.

The invention proposes a simple and cost efficient solution for installing guide rails in an elevator installation.

The invention may shorten the time required for the guide rail installation.

A first lowermost section of guide rails may first be installed manually after which the guide rail elements in the following sections of guide rails may be installed according to the inventive method.

The guide rail elements are lifted upwards in the shaft with a first hoist connected to a transport device comprising a hook device and a lever device. The hook device may be attached to an upper end of the guide rail element and the lower end of the guide rail element may be glidingly supported with the lever device on the row of already installed guide rails.

The guide rail element may thus be lifted in a controlled manner i.e. the guide rail cannot swing during the lifting.

The lowering of the transport apparatus in order to fetch a new guide rail element is also done in a controlled manner. The lever device may also when moving downwards be glidingly supported on the row of already installed guide rail elements. The hook device may also be glidingly supported on the row of already installed guide rail elements when moving downwards, but this is not necessary. The lever device is connected to the hook device and excessive swinging of the hook device when moving downwards is thus prevented.

The hook device is fixedly attached to the upper end of the guide rail element during the lifting of the guide rail element.

The transport platform may then be used to connect the guide rail element to the upper end of the row of already installed guide rail elements and to attach the guide rail element to a wall in the shaft. This may be done manually by a technician or automatically by a robot from the transport platform.

DRAWINGS

Figure 2:
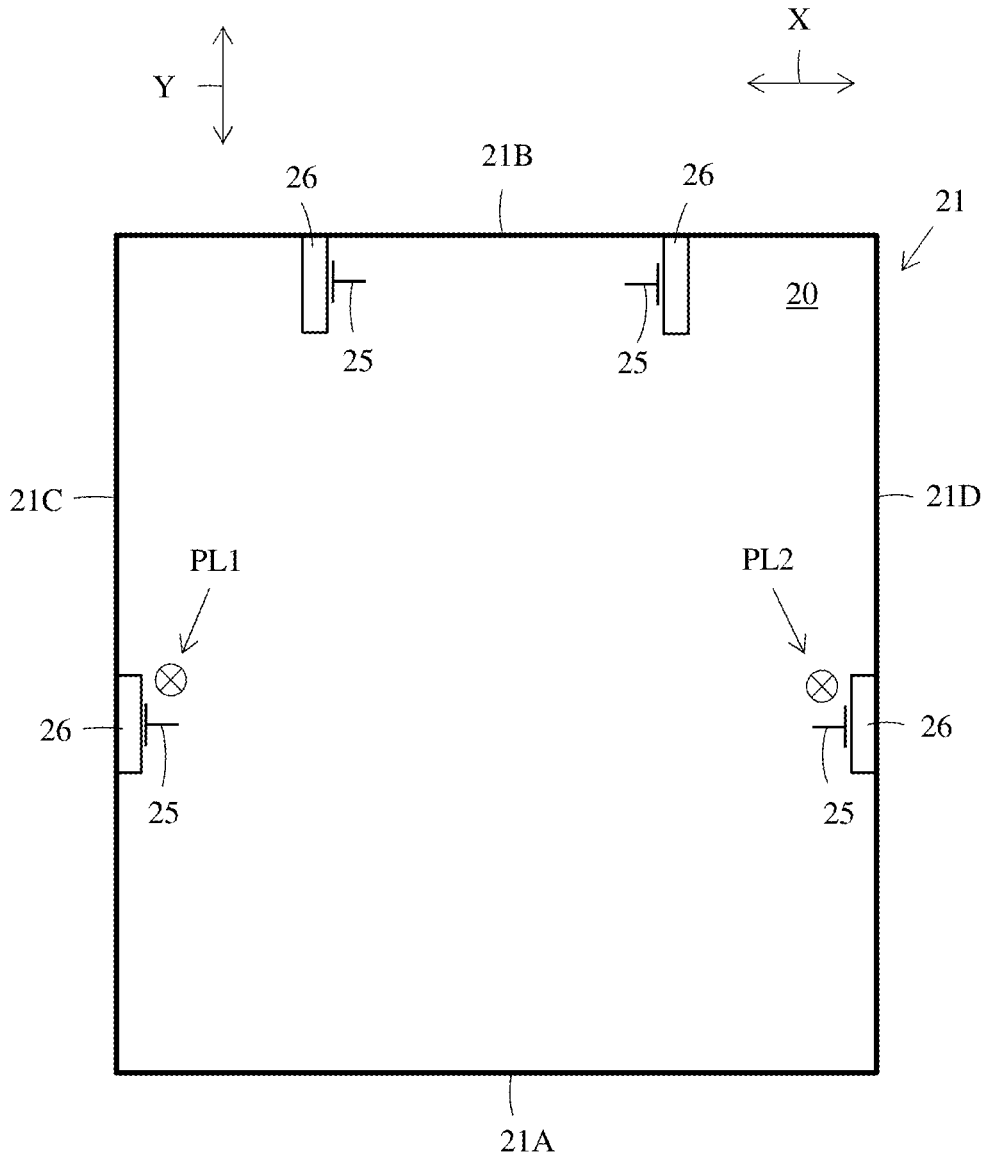
Figure 3:
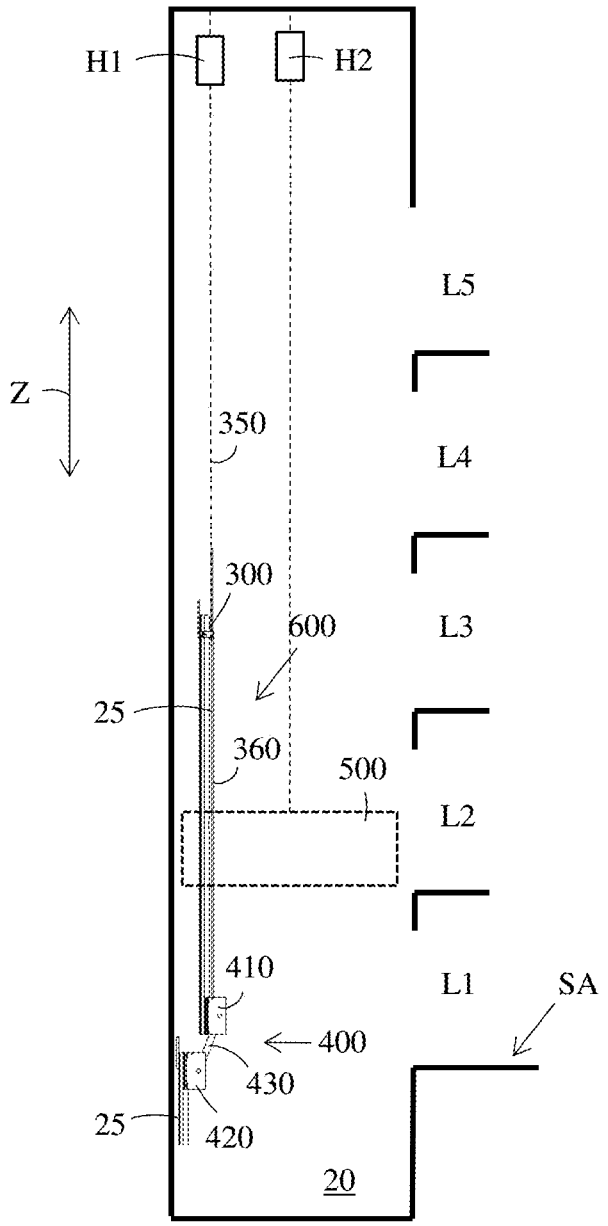
Figure 4:
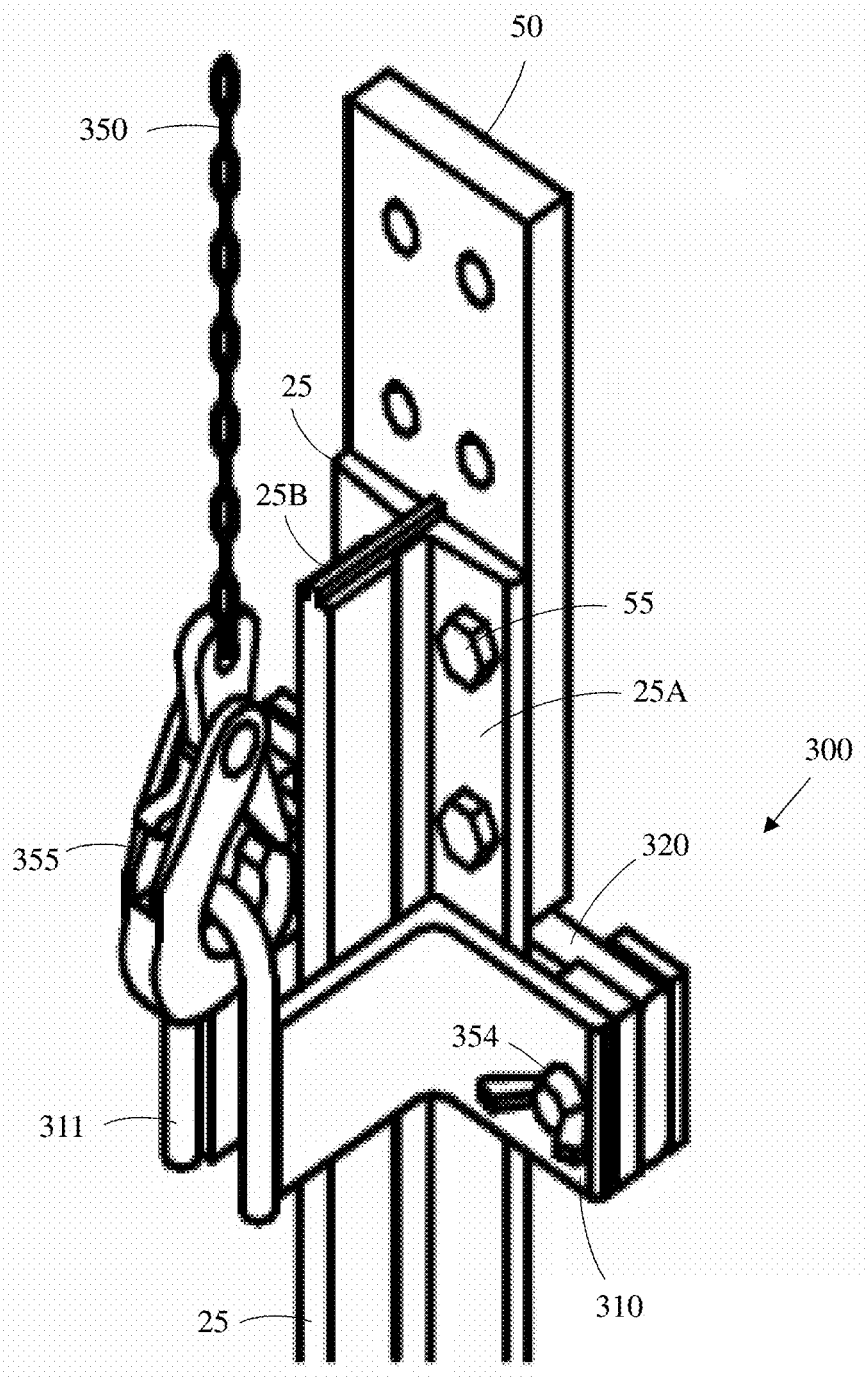
Figure 5:
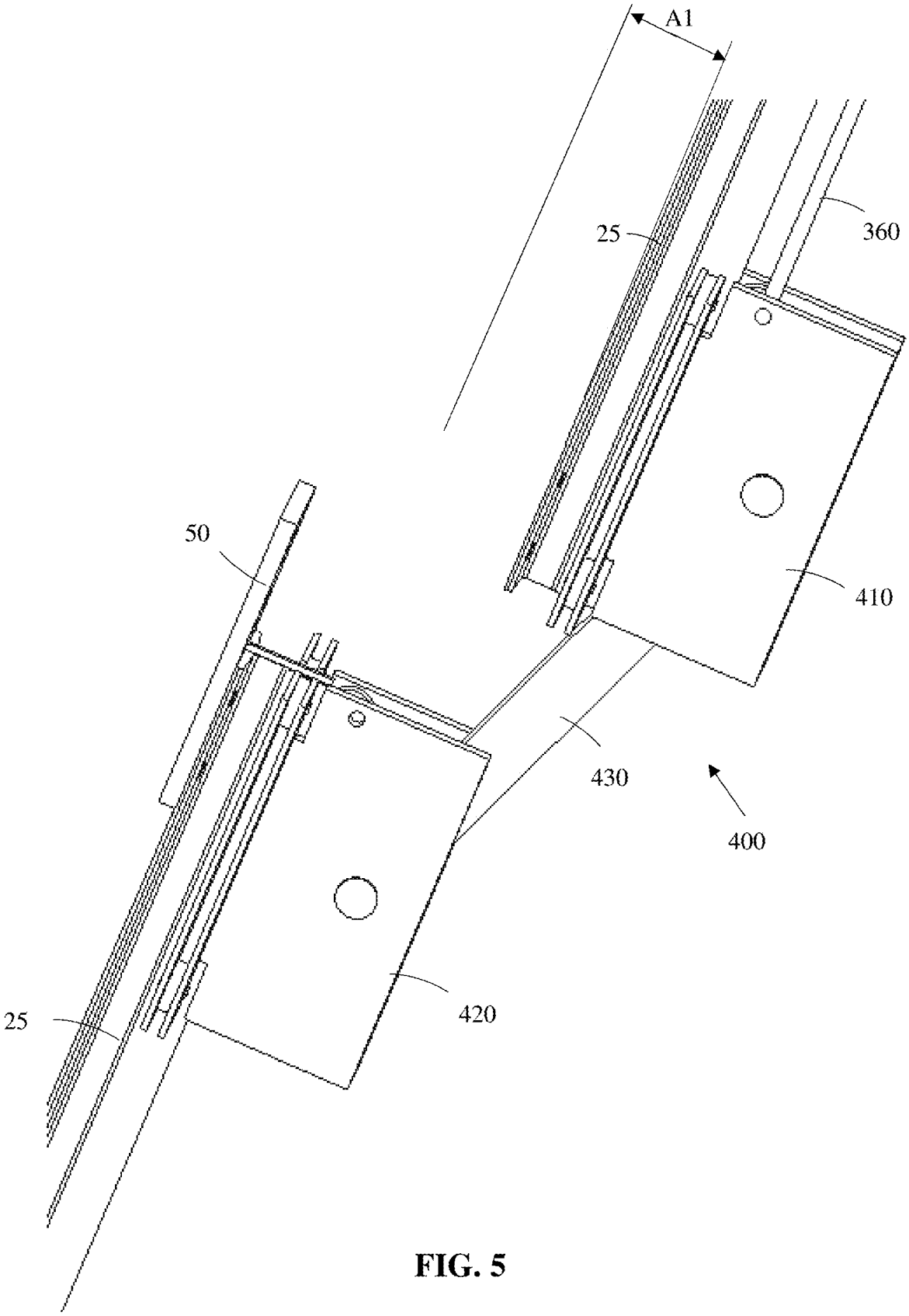
Figure 6:
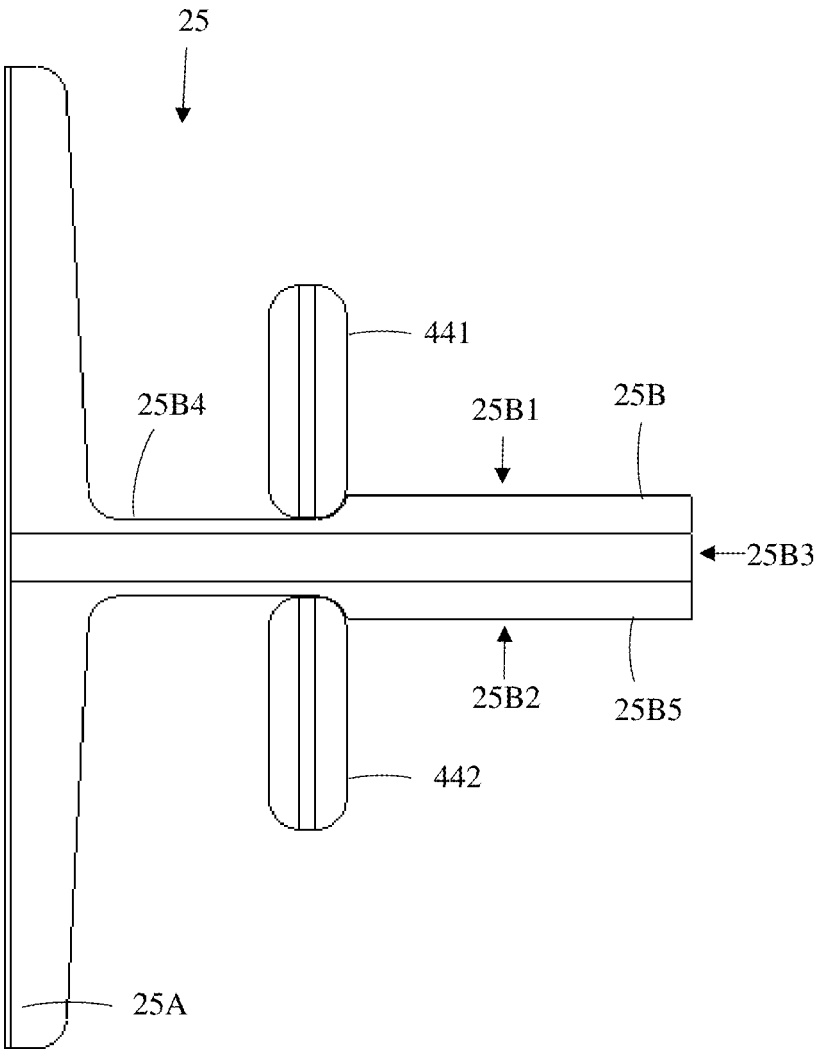
Figure 7:
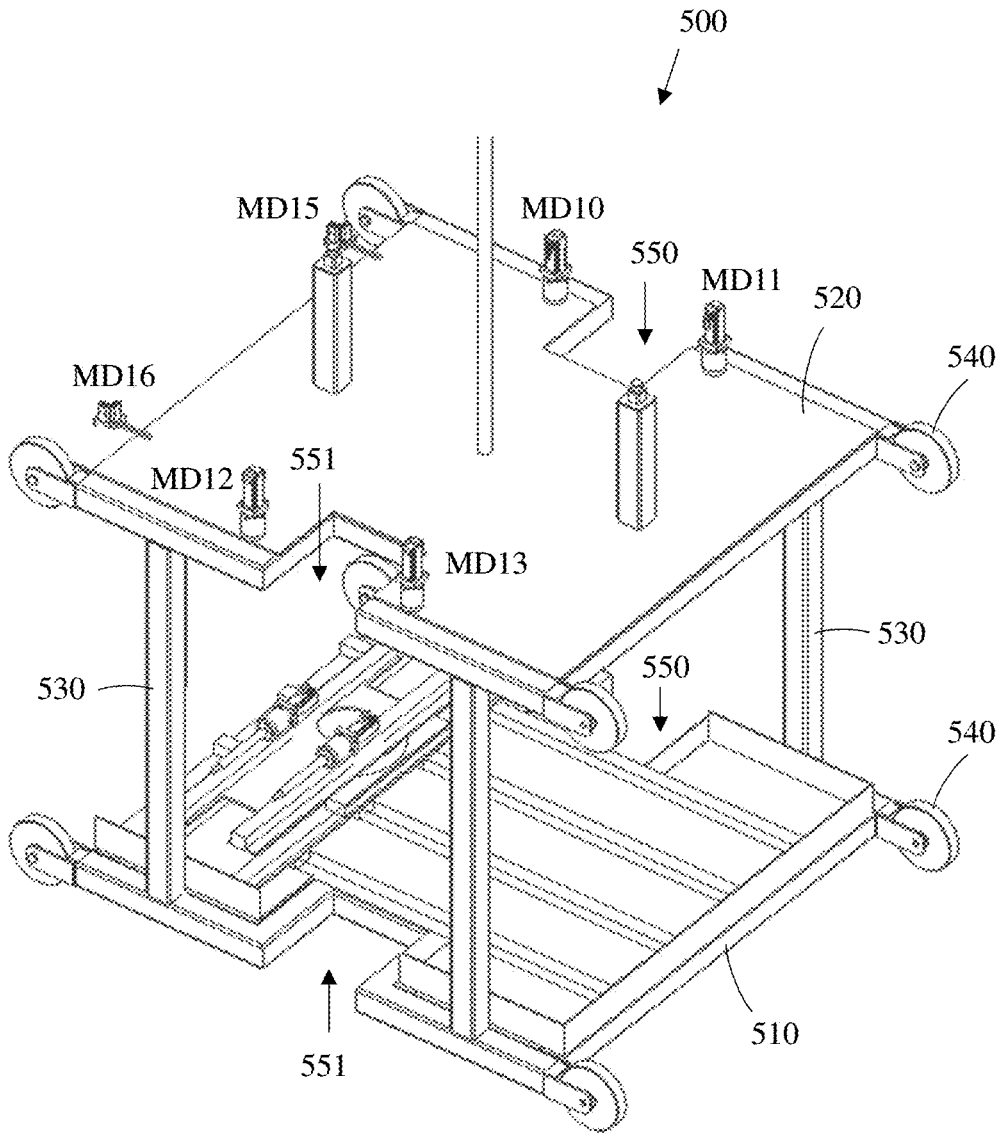
Figure 8:
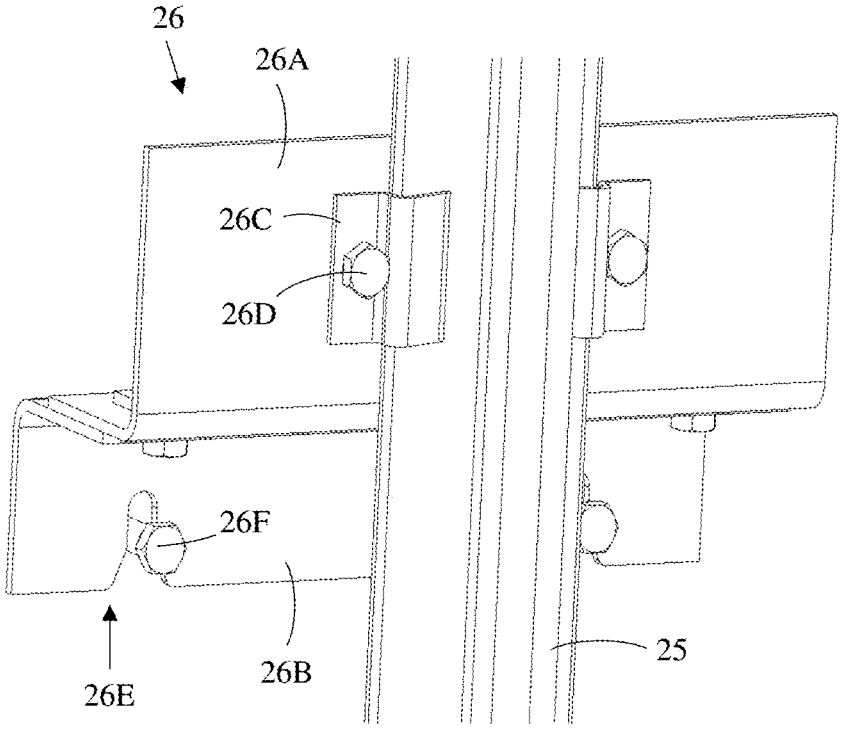
Figure 9:
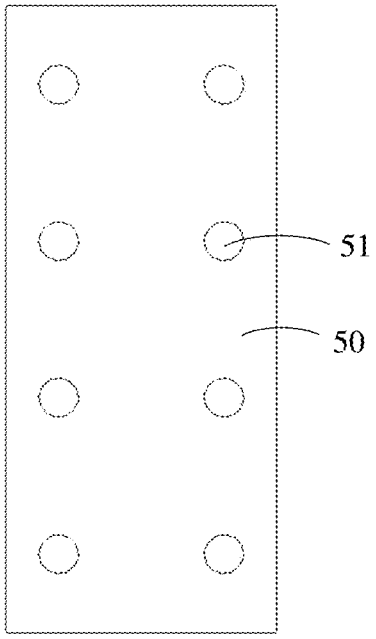

The invention will in the following be described in greater detail by means of preferred embodiments with reference to the attached drawings, in which FIG. 1 shows a side view of an elevator,
FIG. 2 shows a horizontal cross section of the elevator,
FIG. 3 shows an arrangement for installing guide rails,
FIG. 4 shows a hook device of a transport apparatus,
FIG. 5 shows a lever device of a transport apparatus,
FIG. 6 shows a cross-section of a guide rail,
FIG. 7 shows a transport platform,
FIG. 8 shows a bracket,
FIG. 9 shows a connection plate.

DETAILED DESCRIPTION

FIG. 1 shows a side view and FIG. 2 shows a horizontal cross section of the elevator.

The elevator may comprise a car 10, an elevator shaft 20, hoisting machinery 30, ropes 42, and a counterweight 41. A separate or an integrated car frame 11 may surround the car 10.

The hoisting machinery 30 may be positioned in the shaft 20. The hoisting machinery may comprise a drive 31, an electric motor 32, a traction sheave 33, and a machinery brake 34. The hoisting machinery 30 may move the car 10 in a vertical direction Z upwards and downwards in the vertically extending elevator shaft 20. The machinery brake 34 may stop the rotation of the traction sheave 33 and thereby the movement of the elevator car 10.

The car frame 11 may be connected by the ropes 42 via the traction sheave 33 to the counterweight 41. The car frame 11 may further be supported with gliding means 27 at guide rails 25 extending in the vertical direction in the shaft 20. The gliding means 27 may comprise rolls rolling on the guide rails 25 or gliding shoes gliding on the guide rails 25 when the car 10 is moving upwards and downwards in the elevator shaft 20. The guide rails 25 may be attached with fastening brackets 26 to the side wall structures 21 in the elevator shaft 20. The gliding means 27 keep the car 10 in position in the horizontal plane when the car 10 moves upwards and downwards in the elevator shaft 20. The counterweight 41 may be supported in a corresponding way on guide rails that are attached to the wall structure 21 of the shaft 20.

The wall structure 21 of the shaft 20 may be formed of solid walls 21 or of open beam structure or of any combination of these. One or more of the walls may thus be solid and one or more of the walls may be formed of an open beam structure. The shaft 20 may be comprise a front wall 21A, a back wall 21B and two opposite side walls 21C, 21D. There may be two guide rails 25 for the car 10. The two car guide rails 25 may be positioned on opposite side walls 21C, 21D. There may further be two guide rails 25 for the counterweight 41. The two counterweight guide rails 25 may be positioned on the back wall 21B.

The guide rails 25 may extend vertically along the height of the elevator shaft 20. The guide rails 25 may thus be formed of guide rail elements of a certain length e.g. 5 m. The guide rail elements 25 may be installed end-on-end one after the other. The guide rail elements 25 may be attached to each other with connection plates extending between the end portions of two consecutive guide rail elements 25. The connection plates may be attached to the consecutive guide rail elements 25. The ends of the guide rails 25 may comprise some kind of form locking means in order to position the guide rails 25 correctly in relation to each other. The guide rails 25 may be attached to the walls 21 of the elevator shaft 20 with support means at support points along the height of the guide rails 25.

The car 10 may transport people and/or goods between the landings in the building.

FIG. 2 shows plumb lines PL1, PL2 in the shaft 20, which may be produced by plumbing of the shaft 20 at the beginning of the installation of the elevator. The plumb lines PL1, PL2 may be formed with traditional vires or with light sources e.g. lasers having the beams directed upwards along the plumb lines PL1, PL2. One plumb line and a gyroscope or two plumb lines are normally needed for a global measurement reference in the shaft 20.

FIG. 1 shows a first direction S1, which is a vertical direction in the elevator shaft 20. FIG. 2 shows a second direction S2, which is the direction between the guide rails (DBG) and a third direction S3, which is the direction from the back wall to the front wall (BTF) in the shaft 20. The second direction S2 is perpendicular to the third direction S3. The second direction S2 and the third direction S3 are perpendicular to the first direction S1.

FIG. 3 shows an arrangement for installing guide rails.

The figure shows five landings L1-L5 in the shaft 20, but there could naturally be any number of landings in the shaft 20.

A first hoist H1 may be arranged in the shaft 20 in order to move a transport apparatus 600 upwards and downwards in the shaft 20. The first hoist H1 may be suspended from a ceiling of the shaft 20.

A second hoist H2 may be arranged in the shaft 20 in order to move a transport platform 500 upwards and downwards in the shaft 20. The second hoist H2 may be suspended from the ceiling of the shaft 20.

The transport platform 500 may be supported with rolls on opposite solid walls 21 in the shaft 20. There is no need to connect the transport platform 500 to the guide rails 25 in any way. The transport platform 500 may be used to transport one or more technicians and/or one or more robots and/or tools in the shaft 20. A horizontal cross-section of the transport platform 500 may be provided with passages for the guide rails 25. The transport platform 500 may be used for scanning the shaft before the elevator installation and/or for installing the guide rails to the wall 21 of the shaft 20 and/or for aligning the guide rails 25 after the elevator installation.

A storage area SA may be arranged on the first landing L1. The storage area SA could naturally be arranged at any position below the working level of the guide rail installation. The storage area SA could first be positioned on the first landing L1 and then later relocated to a higher landing as the installation advances. The guide rail elements 25 may be stored on the storage area SA and lifted with the transport apparatus 600. The guide rail elements 25 may be loaded manually on the transport apparatus 600.

A first lowermost section of guide rails 25 may first be installed into the shaft 20 manually. The transport platform 500 may be used in the manual installation of the first section of guide rails 25 to the shaft 20.

The figure shows a situation in which a first guide rail 25 in a second section of guide rails 25 is lifted upwards in the shaft 20 with the transport apparatus 600 connected to the first hoist H1. The transport apparatus 600 may comprise a hook device 300 connected to the first hoist H1 and a lever device 400 connected to the hook device 300. The hook device 300 may be connected with a first wire 350 to the first hoist H1. The lever device 400 may be connected with a second wire 360 to the hook device 300. The lever device 400 could on the other hand be connected with a stiff bar to the hook device 300. A stiff bar would, however, make the loading of guide rail elements 25 to the transport apparatus 600 more difficult. The lever device 400 may comprise an upper lever part 410 and a lower lever part 420. The upper lever part 410 and the lower lever part 420 may be connected to each other with a lever arm 430.

An upper end of the guide rail element 25 to be lifted may be attached to the hook device 300 and thereby to the first hoist H1.

A lower end of the guide rail element 25 to be lifted may be attached to the upper lever part 410. The lower lever part 420 may be glidingly supported on the row of already installed guide rail elements 25.

The guide rail element 25 may thus be lifted with the first hoist H1 and the transport apparatus 600 along the row of already installed guide rail elements 25. The upper end of the guide rail element 25 may be firmly attached to the hook device 300. The lifting force is thus transferred from the first hoist H1 to the hook device 300 and further to the guide rail element 25. The lower end of the guide rail element 25 may be attached to the upper lever part 410. The lower lever part 420 may glide on the row of already installed guide rail elements 25. The lower lever part 420 may be glidingly connected to the row of already installed guide rail elements 25 during the upward movement.

The guide rail element 25 may be lifted along the row of already installed guide rail elements 25 to a height in which the lower lever part 420 reaches the upper end of the row of already installed guide rail elements 25.

The lower end of the guide rail element 25 may now be disconnected from the lever device 400. The lower end of the guide rail element 25 may thereafter be attached with a connection plate to the uppermost end of the row of already installed guide rails 25. This phase in the installation may be done from the transport platform 500 movable with the second hoist H2.

The guide rail element 25 may thereafter be attached with brackets to the wall 21 of the shaft 20. The hook device 300 may thereafter be disconnected from the guide rail element 25. This phase in the installation may also be done from the transport platform 500 movable with the second hoist H2.

The transport device 600 i.e. the lever device 400 and the hook device 300 may thereafter be connected to the row of already installed guide rail elements 25. The transport device 600 may thereafter be moved downwards along the row of already installed guide rail elements 25 with the first hoist H1. The hook device 300 and the lever device 400 may glide on the row of already installed guide rail elements 25 when moving downwards. The hook device 300 and the lever device 400 may be glidingly supported of the row of already installed guide rail elements 25.

The installation work from the transport platform 500 may be done manually by one or more technicians and hand tools and/or automatically with one or more robots.

FIG. 4 shows a hook device of a transport apparatus.

The hook device 300 may comprise a first body portion 310 and a second body portion 320. The first body portion 310 may be formed of two L-shaped brackets connected with a U-shaped hook 311. The two L-shaped brackets may be positioned on opposite sides of the support portion 25B of the guide rail element 25 so that the L-shaped brackets lean on a front surface of the bottom portion 25A of the guide rail 25. The second body portion 320 may be formed of a substantially rectangular bracket positioned against a bottom surface of the bottom portion 25A of the guide rail element 25. The first body portion 310 and the second body portion 320 may be attached to each other with bolts and fly nuts 354. The bolts may pass through holes in the first body part 310 and in the second body part 320 so that the bolts become positioned on opposite sides of the guide rail 25. The guide rail element 25 becomes thus secured between the two body parts 310, 320 of the hook device 300.

A connection plate 50 may be attached to the upper end of the guide rail 25. The connection plate 50 is attached with bolts 55 to the bottom surface of the bottom part 25A of the guide rail element 25. An upper edge of the second body part 320 of the hook device 300 will lean against the lower end surface of the connection plate 50. The connection plate 50 prevents gliding of the hook device 300 upwards along the guide rail element 25 when the guide rail element 25 is lifted with the first wire 350 of the first hoist H1. A hook 355 is attached to the lower end of the first wire 350.

The hook device 300 may be disconnected from the guide rail element 25 by unwinding the fly nuts 354 from the bolts. This can be done from the transport platform 500 when the guide rail element 25 has been lifted to a correct position and the guide rail element 25 has been attached to a wall 21 of the shaft 20.

FIG. 5 shows a lever device of a transport apparatus.

The lever device 400 may comprise an upper lever part 410 and a lower lever part 420 connected with a lever arm 430. The lower lever part 420 may glide on the already installed guide rail 25. A lower end of the guide rail element 25 may be connected to the upper lever part 410.

The lower lever part 420 may glide on the row of already installed guide rail elements 25 in the shaft 20. The lower end of the guide rail element 25 may be supported on the upper lever part 410. The lever arm 430 may be inclined so that the guide rail element 25 may be kept at a distance from the row of already installed guide rail elements 25. The upper lever part 410 may be kept at a distance A1 from the row of already installed guide rail elements 25. This distance A1 leaves room for the guide rail element 25 to pass on the outer side of the row of already installed guide rail elements 25 when the guide rail element 25 is lifted upwards along the row of already installed guide rail elements 25.

A connection plate 50 may be attached to an upper end of each guide rail element 25. The following guide rail element 25 may be attached to connection plate 50 and thereby to the uppermost guide element 25 in the row of already installed guide rail elements 25.

FIG. 6 shows a cross-section of a guide rail.

A cross-section of the guide rail element 25 may have the form of a letter T having a flat bottom portion 25A and a flat support portion 25B protruding outwardly from the middle of the bottom portion 25A. The guide rail element 25 may be attached with brackets to a wall 21 in the shaft 20 from the bottom portion 25A of the guide rail element 25. The support portion 25B of the guide rail element 25 may form two opposite side support surfaces 25131, 25B2 and one end support surface 25B3 for the support shoes of the car 10 or the counterweight 41. The support shoes may be provided with gliding surfaces or rollers acting on the support surfaces 25B1, 25B2, 25B3 of the support portion 25B of the guide rail element 25.

The upper lever part 410 and/or the lower lever part 420 may be provided with rollers 441, 442 or gliding shoes rolling or gliding on the inner thinner portion 25B4 of the support portion 25B of the guide rail 25. The rollers 441, 442 or gliding shoes may be positioned in the transition between the lower thinner portion 25B4 and the outer thicker portion 25B5 of the support portion 25B of the guide rail 25. The rollers 441, 442 in the lower lever part 420 will keep the lower lever device 400 secured to the guide rail 25 during the upwards and downwards movement of the lever device 400 on the guide rail 25. The rollers 441, 442 in the upper lever part 410 will keep the lower end of the guide rail element 25 secured to the upper lever part 410 during the upwards movement of the transport device 600 on the guide rail 25.

The rollers 441, 442 may be movably supported in the lever device 400. The rollers 441, 442 may be moved between a first position in which the rollers 441, 442 are in contact with the guide rail 25 as seen in the figure and a second position in which the rollers 441, 442 are out of contact from the guide rail 25. The lever device 400 may be disconnected from the guide rail 25 when the rollers 441, 442 are in the second position.

Similar rollers 441, 442 may also be used in connection with the hook device 300. The first body part 310 of the hook device 300 could be glidingly supported on the guide rail 25 with rollers. The hook device 300 could thus glide downwards on the row of already installed guide rail elements 25, when the transport device 600 is moved downwards in order to fetch a new guide rail element 25.

FIG. 7 shows a transport platform.

The transport platform 500 may comprise a bottom plane 510 and a roof plane 520 positioned at a vertical distance above the bottom plane 510. The bottom plane 510 may form a work surface for one or more technicians and/or for one or more robots and/or for tools. Vertical support bars 530 may extend between the bottom plane 510 and the roof plane 520. Two support rollers 540 may be provided at opposite ends in each plane 510, 520 in the transport platform 500. The support rollers 540 may support the transport platform 500 on opposite walls 21 in the shaft 20. The support rollers 540 may keep the transport platform 500 substantially in a horizontal plane when the transport platform 500 is moved upwards and downwards in the shaft 20. The transport platform 500 may further be provided with locking means for locking the transport platform 500 to the walls 21 in the shaft 20. The locking means could be realized with hydraulic cylinders acting against two opposite walls 21 in the shaft 20.

By-pass passages 550, 551 for guide rail elements 25 to be lifted during the installation of the guide rails 25 may further be formed in the transport platform 500. The by-pass passages 550, 551 may be formed of recesses protruding inwards from a perimeter of the transport platform 500. The by-pass passages 550, 551 may also provide space for the plumb lines PL1, PL2 to by-pass the transport platform 500.

The transport platform 500 may be provided with measuring devices MD10, MD11, MD12, MD13 for measuring the position of the transport platform 500 in relation to the shaft 20. The measuring devices MD10, MD11, MD12, MD13 may determine the position of the transport platform 500 in the shaft 20 based on the plumb lines PL1, PL2 once the transport platform 500 is locked in the shaft 20. The measuring devices MD10, MD11, MD12, MD13 can be based on a sensor measuring without contact the position of the plumb lines PL1, PL2 being formed of wires. Another possibility is to use light sources e.g. lasers on the bottom of the elevator shaft producing upwards directed light beams that can be measured with the measuring devices MD10, MD11, MD12, MD13 on the transport platform 500. The measuring devices MD10, MD11, MD12, MD13 could be light sensitive sensors or digital imaging devices measuring the hit points of the light beams produced by the light sources. The light source could be a robotic total station, whereby the measuring devices MD10, MD11, MD12, MD13 would be reflectors reflecting the light beams back to the robotic total station. The robotic total station would then measure the position of the measuring devices MD10, MD11, MD12, MD13.

The transport platform 500 may further be provided with distance measurement devises MD15, MD16 for measuring the vertical position i.e. the height position of the transport platform 500 in the shaft 20. The distance measurement may be based on a laser measurement.

FIG. 8 shows a bracket.

The bracket 26 may be formed of two separate parts 26A, 26B that are movably connected to each other. A first part 26A of the bracket 26 may be attached to the guide rail 25 and a second part 26B of the bracket 26 may be attached to a wall 21 in the shaft 20. The first part 26A and the second part 26B may have the shape of a letter L with a vertical portion and a horizontal portion. The first part 26A of the bracket 26 may be attached from the vertical portion with a clamp 26C and a bolt 26D to the guide rail 25. The second part 26B of the bracket 26 may be attached from the vertical portion to the wall 21 in the shaft 20. The horizontal portions of the first part 26A and the second part 26B of the bracket 26 may be attached to each other with bolts passing through openings is said horizontal portions of the first 26A and the second 26B part of the bracket 26. The openings may be dimensioned so that it is possible to fine adjust the position of the first part 26A and the second part 26B of the bracket 26 in order to be able to align the guide rails 25.

The second part 26B of the bracket 26 may be attached to the wall in the shaft 20 with anchor bolts 26F. The vertical portion in the second part 26B of the bracket 26 may comprise oblong openings 26E being open at the lower end of the vertical portion in the second part 26B. Holes for the anchor bolts 26F may be drilled into the walls 21 of the shaft 20 at predetermined positions. Anchor bolts 26F may be screwed into the holes. The bolts 26F may be screwed only partly into the threading so that the head of the bolts 26F is at a distance from the fastening surface. The second part 26B of the bracket 26 may then be attached to the wall 21 of the shaft 20 before the guide rail 25 installation or during the guide rail 25 installation.

Tightening of the bolts 26F will attach the second part 26B of the bracket 26 to the wall 21 in the shaft 20. The bolts 26F may be tightened from the transport platform 500 manually by a technician or with a robot.

FIG. 9 shows a connection plate.

The connection plate 50 may have a rectangular shape provided with holes 51 for fastening bolts. The connection plate 50 may be positioned against the bottom of the bottom part 25A in the guide rail element 25. Fastening bolts may pass through the holes 51 in the connection plate 50 and through corresponding holes in the bottom part 25A of the guide rail element 25. Two consecutive guide rail elements 25 may thus be connected with the connection plate 50.

The guide rails 25 may be aligned after they have been installed to the respective walls 21 in the shaft 20. The alignment of the guide rails 25 may be done in any known manner.

The figures show an embodiment in which only one first hoist H1 with a transport device 600 is used. The suspension point for the first hoist H1 would have to be changed during the installation. Each row of guide rail elements 25 to be installed would need a suspension point of their own for the first hoist H1. Several first hoists H1 could naturally be suspended from the ceiling of the shaft 20. Each first hoist H1 would thus be provided with a transport device 600 of its own. This would mean that several rows of guide rail elements 25 could be installed simultaneously into the shaft 20.

The shaft 20 in the figures is intended for only one car 10, but the invention could naturally be used in shafts intended for several cars 10. Such elevator shafts 10 could be divided into sub-shafts for each car 10 with steel bars. Horizontal steel bars could be provided at predetermined intervals along the height of the shaft 20. A part of the guide rails 25 would then be attached to the steel bars in the shaft 20. Another part of the guide rails 25 would be attached to solid walls 21 in the shaft 20.

The invention may be used in low rise or in high rise buildings. The benefits of the invention are naturally greater in high rise buildings. High rise buildings may have a hoisting height over 75 meters, preferably over 100 meters, more preferably over 150 meters, most preferably over 250 meters.

The use of the invention is not limited to the elevator disclosed in the figures. The invention can be used in any type of elevator e.g. an elevator comprising a machine room or lacking a machine room, an elevator comprising a counterweight or lacking a counterweight. The counterweight could be positioned on either side wall or on both side walls or on the back wall of the elevator shaft. The drive, the motor, the traction sheave, and the machine brake could be positioned in a machine room or somewhere in the elevator shaft. The car guide rails could be positioned on opposite side walls of the shaft or on a back wall of the shaft in a so called ruck-sack elevator.

It will be obvious to a person skilled in the art that, as the technology advances, the inventive concept can be implemented in various ways. The invention and its embodiments are not limited to the examples described above but may vary within the scope of the claims.

The invention claimed is:

1. A method of installing guide rails in an elevator shaft, the method comprising:

installing a lowermost first section of guide rail elements to respective walls of the elevator shaft;

arranging a first hoist for moving a transport apparatus upwards and downwards in the elevator shaft, the transport apparatus including a hook device connected to the first hoist and a lever device connected to the hook device, the lever device including a lower lever part and an upper lever part connected via a lever arm, the lower lever part being movable supported with rollers or gliding shoes on already installed guide rail elements while the lever arm maintains a distance between the upper lever part and the already installed guide rail elements;

arranging a second hoist for moving a transport platform upwards and downwards in the elevator shaft;

connecting an uninstalled guide rail element among the guide rail elements to the transport apparatus so that an upper end of the uninstalled guide rail element is connected to the hook device and a lower end of the uninstalled guide rail element is connected to the upper lever part of the lever device;

moving the uninstalled guide rail element upwards by moving the transport apparatus upwards with the first hoist such that the lower lever part of the lever device moves on the already installed guide rail elements as the transport apparatus moves upwards with the uninstalled guide rail element connected to the upper lever part spaced the distance apart from the already installed guide rail elements;

connecting the uninstalled guide rail element to an upper end of the already installed guide rail elements and attaching the uninstalled guide rail element to a wall of the elevator shaft from the transport platform; and moving the transport apparatus downwards with the first hoist to fetch a new uninstalled guide rail element among the guide rail elements while the lower lever part of the lever device glides on the already installed guide rails.

2. The method according to claim 1, wherein a connection plate is used to connect the guide rail element to the upper end of the already installed guide rail element, the connection plate being attached to a lower end portion of the guide rail element and to an upper end portion of the uppermost guide rail element in the already installed guide rail elements.

3. The method according to claim 1, wherein the guide rail element is attached to the wall of the elevator shaft with brackets comprising a first part that is attached to the guide rail and a second part that is attached to the wall of the elevator shaft, said two parts of the bracket being adjustably attached to each other.

4. The method according to claim 1, wherein the transport platform is supported with rolls on opposite solid walls in the elevator shaft.

5. The method according to claim 1, wherein the transport platform includes recesses therein forming by-pass passages such that the moving the uninstalled guide rail upwards moves the uninstalled guide rail element through the by-pass passages.

6. An arrangement configured to install guide rails in an elevator shaft, the arrangement comprising:

a lowermost first section of guide rail elements installed to respective walls of the elevator shaft;

a first hoist for moving a transport apparatus upwards and downwards in the elevator shaft, the transport apparatus including a hook device connected to the first hoist and a lever device connected to the hook device, the lever device including a lower lever part and an upper lever part connected via a lever arm, the lower lever part being movable supported with rollers or gliding shoes on already installed guide rail elements while the lever arm maintains a distance between the upper lever part and the already installed guide rail elements; and a second hoist for moving a transport platform upwards and downwards in the elevator shaft;

wherein the first hoist is configured to, move an uninstalled guide rail element among the guide rail elements upwards by moving the transport apparatus upwards such that the lower lever part of lever device moves on the already installed guide rail elements as the transport apparatus moves upwards with the uninstalled guide rail element connected to the upper lever part spaced the distance apart from the already installed guide rail elements, and after the uninstalled guide rail element is then connected to an upper end of the already installed guide rail elements and attached to a wall of the elevator shaft from the transport platform, move the transport apparatus in order to fetch a new uninstalled guide rail element among the guide rail elements while the lower lever part of the lever device glides on the already installed guide rail elements.

7. The arrangement according to claim 6, wherein the guide rail element is connected to an upper end of the already installed guide rail elements with a connecting plate, the connection plate being attached to a lower end portion of the guide rail element and to an upper end portion of the uppermost guide rail element in the already installed guide rail elements.

8. The arrangement according to claim 6, wherein the guide rail element is attached to the wall of the elevator shaft with brackets comprising a first part that is attached to the guide rail and a second part that is attached to the wall of the elevator shaft, said two parts of the bracket being adjustably attached to each other.

9. The arrangement according to claim 6, wherein the transport platform is supported with rolls on opposite solid walls in the elevator shaft.

10. The arrangement according to claim 6, wherein the transport platform includes recesses therein forming by-pass passages such that the first hoist is configured to move the uninstalled guiderail upwards via the transport apparatus such that the uninstalled guide rail is convey through the by-pass passages.

* * * * *